US007688226B2

(12) United States Patent
McCall

(10) Patent No.: US 7,688,226 B2
(45) Date of Patent: Mar. 30, 2010

(54) VEHICLE LOCATION DEVICE AND METHOD

(75) Inventor: Clark E. McCall, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 342 days.

(21) Appl. No.: 11/756,670

(22) Filed: Jun. 1, 2007

(65) Prior Publication Data

US 2008/0297376 A1 Dec. 4, 2008

(51) Int. Cl.
*G08G 1/123* (2006.01)

(52) U.S. Cl. ..... 340/991; 340/993; 340/995.17

(58) Field of Classification Search ..... 340/988, 340/989, 990, 991, 993, 995, 996, 539.1, 340/539.11, 426.14, 426.19, 995.17, 932.2; 701/200, 207; 342/457
See application file for complete search history.

(56) References Cited

U.S. PATENT DOCUMENTS 5,777,580 A * 7/1998 Janky et al. ..... 342/457
6,909,964 B2 * 6/2005 Armstrong et al. ..... 701/207
7,260,473 B2 * 8/2007 Abe et al. ..... 701/200
2007/0022445 A1 * 1/2007 Arseneau et al. ..... 725/74
2007/0126603 A1 * 6/2007 Driscoll et al. ..... 340/988
2007/0184852 A1 * 8/2007 Johnson et al. ..... 455/456.1

* cited by examiner

*Primary Examiner*—Van T. Trieu
(74) *Attorney, Agent, or Firm*—Ingrassia Fisher & Lorenz, P.C.

(57) ABSTRACT

An electronic device configured to be carried on a user's person is provided for directing the user to a parked vehicle. The electronic device utilizes node location data provided by at least one local wireless node and vehicle location information provided by the vehicle. The electronic device includes a network receiver and a controller coupled thereto. The network receiver is configured to receive the node location data from the at least one local wireless node. The controller is configured to store the vehicle location information, to estimate the location of the electronic device from the received node location data, and to determine the position of the vehicle relative to the electronic device.

18 Claims, 5 Drawing Sheets

VEHICLE LOCATION DEVICE AND METHOD

TECHNICAL FIELD

The present invention generally relates to an apparatus and method for locating a vehicle and, more particularly, to an electronic device and method for guiding a user to a parked vehicle.

BACKGROUND OF THE INVENTION

Many drivers, at one time or another, have experienced difficulty in locating a vehicle that they have previously parked. Malls, airports, and other large venues often feature parking garages or tiered parking structures that make losing a vehicle particularly easy and finding a misplaced vehicle particularly challenging. Portable electronic devices have been developed that may help a driver locate a parked vehicle. However, many of these devices include an integrated GPS system, which must identify the GPS location of the device before the relative position of the vehicle may be determined. As a result of this GPS-dependency, such devices may fail to operate properly in areas where satellite reception is poor or lacking. Unfortunately, such areas may include parking garages and tiered parking structures.

There thus exists an ongoing need to provide a parked vehicle location system that may guide a user back to his or her vehicle without the aid of satellite signals. It would be desirable if such a device were integrated into an existing electronic device of the type typically carried by a driver, such as a keyfob. Other desirable features and characteristics of the present invention will become apparent from the subsequent detailed description and the appended claims, taken in conjunction with the accompanying drawings and the foregoing technical field and background.

SUMMARY OF THE INVENTION

An electronic device configured to be carried on a user's person is provided for directing the user to a parked vehicle. The electronic device utilizes node location data provided by at least one local wireless node and vehicle location information provided by the vehicle. The electronic device includes a network receiver and a controller coupled thereto. The network receiver is configured to receive the node location data from the at least one local wireless node. The controller is configured to store the vehicle location information, to estimate the location of the electronic device from the received node location data, and to determine the position of the vehicle relative to the electronic device.

DESCRIPTION OF THE DRAWINGS

The present invention will hereinafter be described in conjunction with the following drawing figures, wherein like numerals denote like elements, and.

DESCRIPTION OF AN EXEMPLARY EMBODIMENT

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
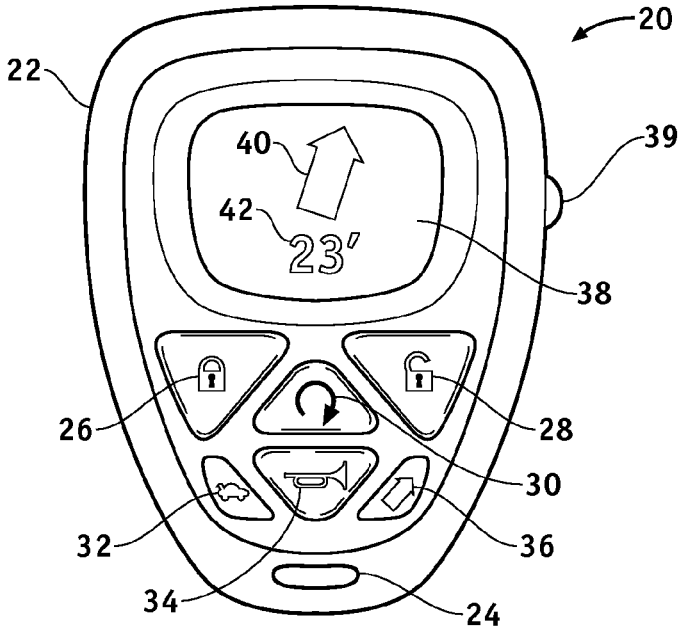
FIG. 1 is a plan view of a keyfob having a parked vehicle location function in accordance with a first exemplary embodiment of the present invention.

FIG. 1 is a plan view of a keyfob 20 having a parked vehicle location function in accordance with a first exemplary embodiment of the present invention. Keyfob 20 comprises a housing 22 having an opening 24 therethrough that enables keyfob 20 to be attached to a keychain in the well-known manner. A plurality of buttons is provided on the exterior of housing 22 and may include, for example, a LOCK button 26, an UNLOCK button 28, a REMOTE START button 30, a TRUNK UNLOCK button 32, a PANIC button 34, and a FIND PARKED VEHICLE button 36. Keyfob 20 further comprises a display (e.g., a liquid crystal display) 38 that may display status information relating to a vehicle (or vehicles) associated with keyfob 20. This status information may include the vehicle's mileage, tire pressure, current fuel level, radio station settings, and door lock status. A scroll wheel 39 may be mounted on a side of housing 22 and utilized to navigate amongst such data. For example, a user may rotate scroll wheel 39 to navigate between vehicular features and depress scroll wheel 39 to select a desired feature and view status information associated therewith.

When a user depresses FIND PARKED VEHICLE button 36, keyfob 20 provides visual prompts on display 38 that may guide the user back to his or her parked vehicle in the manner described below. For example, as indicated in FIG. 1, an arrow 40 may be generated on display 38 indicating the position of the vehicle relative to the heading of keyfob 20. In addition, an estimated keyfob-to-car distance may also be displayed on display 38 as shown at 42. This example notwithstanding, it should be appreciated that other embodiments of keyfob 20 may utilize other visual indications to guide a user back to the vehicle. In still other embodiments, keyfob 20 may produce audible signals in addition to, or in lieu of, visual signals.

Figure 2:
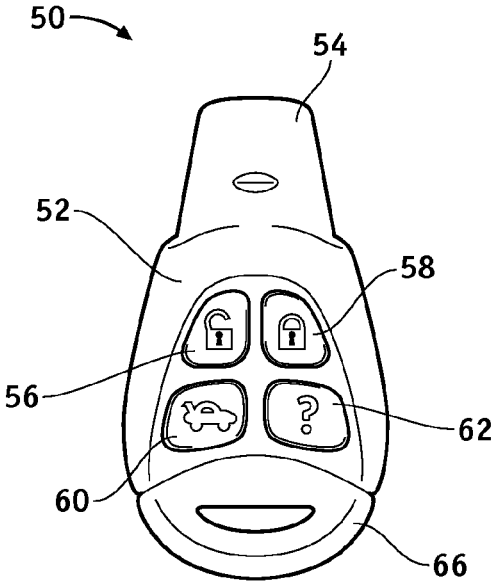
FIGS. 2 and 3 are front and rear plan views, respectively, of a keyfob having a parked vehicle location function in accordance with a second exemplary embodiment of the present invention.
Figure 3:
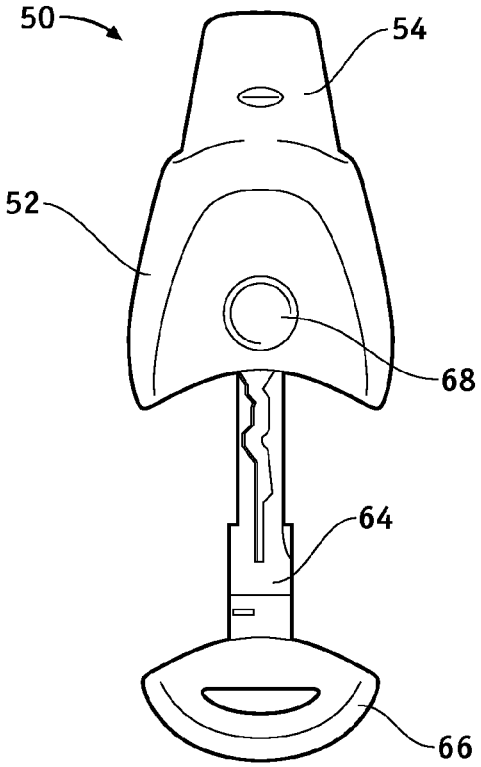

FIGS. 2 and 3 are front and rear plan views, respectively, of a keyfob 50 in accordance with a second exemplary embodiment of the present invention. Keyfob 50 comprises a housing 52 including a protruding stem portion 54. A plurality of buttons is disposed on housing 52 and may include an UNLOCK button 56, a LOCK button 58, a TRUNK OPEN button 60, and a FIND PARKED VEHICLE button 62. Housing 52 includes a cavity therein that may receive the blade 64 (FIG. 3) of a mechanical key 66, such as a spare key. Key 66 may be secured within housing 52 by a latch mechanism, which may be released by, for example, depressing a button 68 (FIG. 3) provided on the exterior of housing 52. During normal use of keyfob 50, mechanical key 66 remains stowed within housing 52. However, if keyfob 50 ceases to operate properly (e.g., if the battery contained within keyfob 50 becomes discharged), mechanical key 66 may be removed and used to manually unlock, lock, and/or start the vehicle.

Stem portion 54 may be received by a receptacle (e.g., a socket) provided within the passenger compartment of a vehicle. Such a receptacle may be configured to supply power to keyfob 50 and, possibly, to recharge a battery disposed within housing 52. For example, the receptacle may employ a conventional electromagnetic induction system comprising an oscillator circuit and a first coil. The oscillator circuit may intermittently activate the first coil to generate a time-varying magnetic field proximate the receptacle. A second coil (not shown) may be disposed within stem portion 54 and coupled to a microcontroller contained within housing 52. When stem portion 54 is inserted into the receptacle, a voltage is induced in the second coil, which keyfob 50 may use as an energy source to power its microcontroller and/or to recharge its battery.

As was the case with keyfob 20, keyfob 50 is configured such that FIND PARKED VEHICLE button 62 may be utilized to activate a vehicle location function incorporated into keyfob 50. However, unlike keyfob 20, keyfob 50 utilizes a sound generator disposed within housing 52 to provide audio cues (e.g., a series of beeps) indicative of the position of the vehicle relative to keyfob 50 as described in more detail below.

Keyfob 20 (FIG. 1) and keyfob 50 (FIGS. 2 and 3) preferably communicate with their associated vehicle via radiofrequency signals; however, it should be appreciated that other wireless communications means may be utilized as well, including, but not limited to, an induction-based means, a low frequency (e.g., 30-300 kHz) communication means, or an infrared means. Furthermore, other embodiments may comprise a keyfob that communicates with a vehicle over a hard wire connection; e.g., a keyfob having a mechanical blade fixedly coupled thereto that carries an electrical connector (e.g., a D-subminiature connector, a multi-pin USB connector similar to that employed by a portable flash drive device, etc.) that permits electrical communication with the vehicle when the blade is inserted into the vehicle's ignition.

Figure 4:
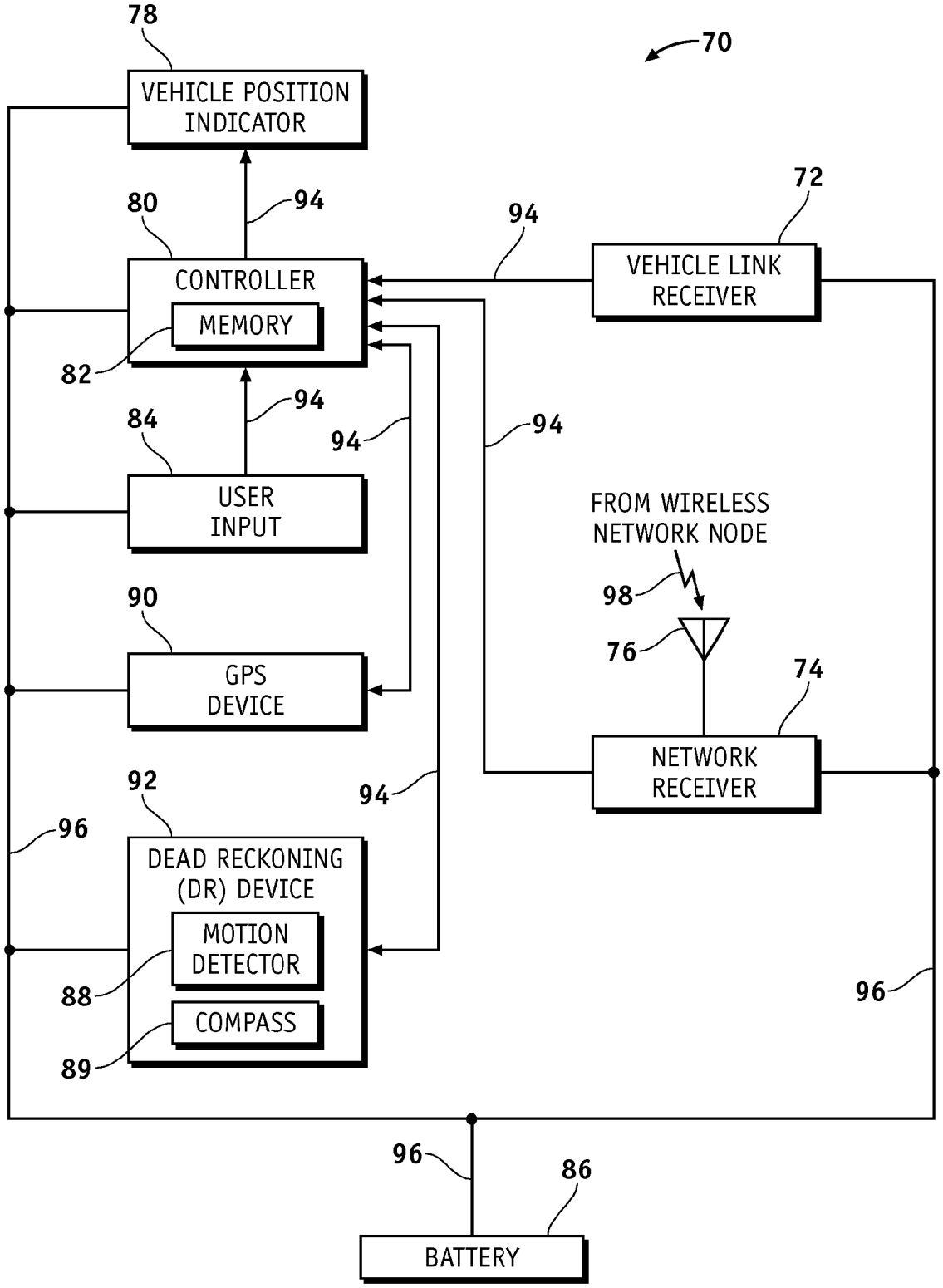
FIG. 4 is a block diagram of a vehicle location system that may be incorporated into a portable electronic device, such as the keyfob shown in FIG. 1, the keyfob shown in FIGS. 2 and 3, or the keyfob shown in FIG. 8.

FIG. 4 is a block diagram of a parked vehicle location system 70 that may be incorporated into a portable electronic device, including, but not limited to, a mobile phone, a digital watch, a digital audio file player (e.g., an MP3 or MP4 player), or a personal digital assistant (PDA). This notwithstanding, location system 70 is preferably incorporated into a keyfob and will consequently be described below as incorporated into keyfob 20 shown in FIG. 1 and keyfob 50 shown in FIGS. 2 and 3.

Location system 70 comprises a vehicle link receiver 72, a network receiver 74 including an antenna 76, a parked vehicle position indicator 78, a controller 80 (e.g., a microcontroller) including a memory 82, a user input 84 (e.g., a button, such as button 36 shown in FIG. 1 or button 62 shown in FIG. 2), and a battery 86. In the illustrated embodiment, location system 70 also comprises a global positioning (GPS) device 90 and a dead reckoning (DR) device 92 including a motion detector 88 and an electronic compass 89; however, other embodiments of the present invention may not include one or more of these components. A plurality of communications lines 94 operatively couple controller 80 to the other components of location system 70. For example, controller 80 may receive electrical signals from vehicle link receiver 72, network receiver 74, user input 84, GPS device 90, and DR device 92 (and thus from motion detector 88 and compass 89); and controller 80 may send electrical signals to position indicator 78 and GPS device 90. Battery 86 supplies power to each of the components of location system 70 via connections 96.

Position indicator 78 may comprise any indication means suitable for providing a user with information useful in locating a parked vehicle. Position indicator 78 may be, for example, a sound generator or a visual signal generator (e.g., a display, such as display 38 shown in FIG. 1). Similarly, vehicle link receiver 72 may comprise any device suitable for receiving data from a vehicle indicative of the vehicle's location (referred to herein as vehicle location information). For example, vehicle link receiver 72 may comprise a wireless transceiver, such as an RF transceiver having an antenna adapted to operate at a desired frequency; e.g., approximately 315 MHz (US and Japan) or 433 MHz (Europe).

Network receiver 74 is configured to receive signals broadcast by nearby wireless network nodes (indicated in FIG. 4 at 98), and to provide related signals to controller 80. To this end, controller 80 and network receiver 74 may be configured in accordance with common compatibility standards for wireless local area networks (e.g., Wi-Fi standards) or for personal area networks (e.g., Bluetooth standards). In certain exemplary embodiments, controller 80 and network receiver 74 may be configured in accordance with low data transmission rate networks (e.g., IEEE 802.15.4, such as a Zigbee network). Such low data rate standards have a data transmission rate slower than that of Wi-Fi or Bluetooth standards (e.g., 250 Kbps at 2.4 GHz), but consume relatively little power and thus may help prolong the life of battery 86. For this reason, adapting controller 80 and network receiver 74 to operate at low data transmission rate standards may be especially desirable in embodiments wherein battery 86 is not readily capable of being recharged.

As indicated above, location system 70 may be provided with a motion detector 88, which may be incorporated into a dead reckoning device, such as DR device 92. Motion detector 88 may comprise any movement-sensitive device. For example, motion detector 88 may comprise a circular spring mounted concentric to a pin or wire that passes freely through the center of the circular spring. When motion detector 88 experiences any significant amount of motion, the spring deflects and touches the pin or wire to complete an electrical circuit. When the motion stops, the surrounding spring returns to its quiescent state wherein the pin or wire is not contacted. Such a motion detectors are well-known in the art and desirable for use in conjunction with system 70 due to their modest power requirements.

To measure traveled distance, DR device 92 may utilize motion detector 88 as a pedometer; that is, DR device 92 may utilize motion detector to measure the number of steps taken by a user. To estimate the direction traveled, DR device 92 may further employ a compass, such as electronic compass 89. Utilizing information provided from DR device 92 relating to distance and direction of movement, controller 80 may estimate the location of location system 70 relative to a known reference point in the well-known manner. DR devices suitable for use as DR device 92 are known and commercially available.

In certain embodiments, vehicle location system 70 may include a conventional GPS device 90. When able to receive satellite signals of sufficient quality, GPS device 90 may be utilized to determine the location of location system 70 and, thus, the location of a portable electronic device (e.g., a keyfob) housing system 70. However, in the absence of GPS data, location system 70 may determine its location by reference to node location data provided by one or more wireless network nodes as explained in more detail below.

Figure 5:
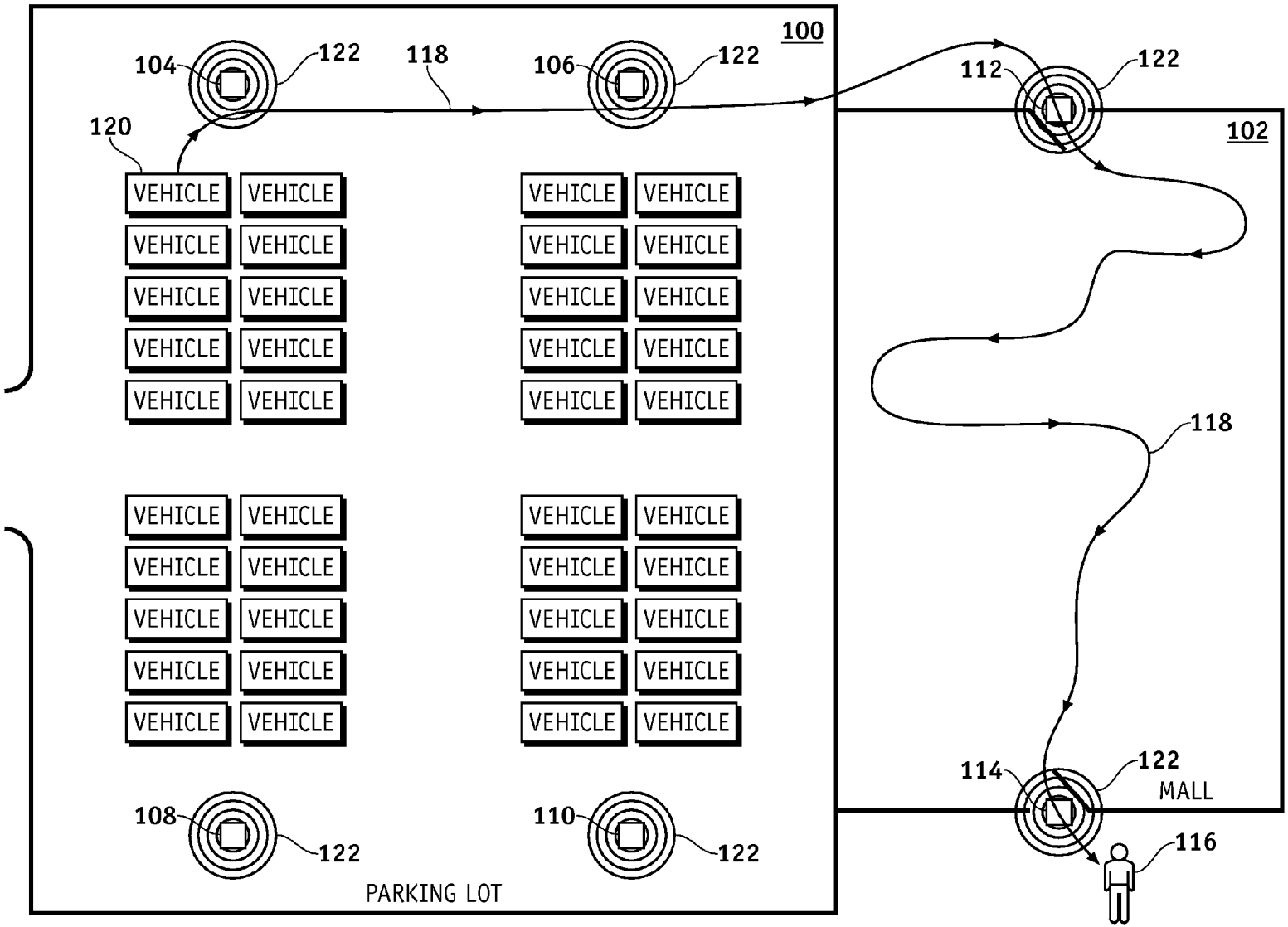
FIG. 5 is a map of a shopping mall and parking area including a plurality of nodes for assisting a user's return to a parked vehicle.

FIG. 5 illustrates a network of local wireless nodes disposed at various locations in a parking area (e.g., a parking garage) 100 and a neighboring shopping mall 102. Six such nodes are shown: nodes 104, 106, 108, 110, 112, and 114. Nodes 104, 106, 108, and 110 are each disposed in a different quadrant of parking area 100, and nodes 112 and 114 are disposed at the North and South entrances, respectively, of shopping mall 102. Although the communication or transmission range 122 for each of the wireless nodes is shown in FIG. 5 as being relatively limited, this is for clarity; wireless nodes 104, 106, 108, 110, 112, and 114 may each transmit a signal detectable over relatively large range (e.g., a low-power Zigbee network node may have a transmission range of approximately 50 meters). The following description will refer to FIG. 5 in conjunction with FIGS. 4 and 6 in describing an exemplary manner in which location system 70 (FIG. 4) may guide a user 116 back to a parked vehicle 120 after the user has walked path 118.

Figure 6:
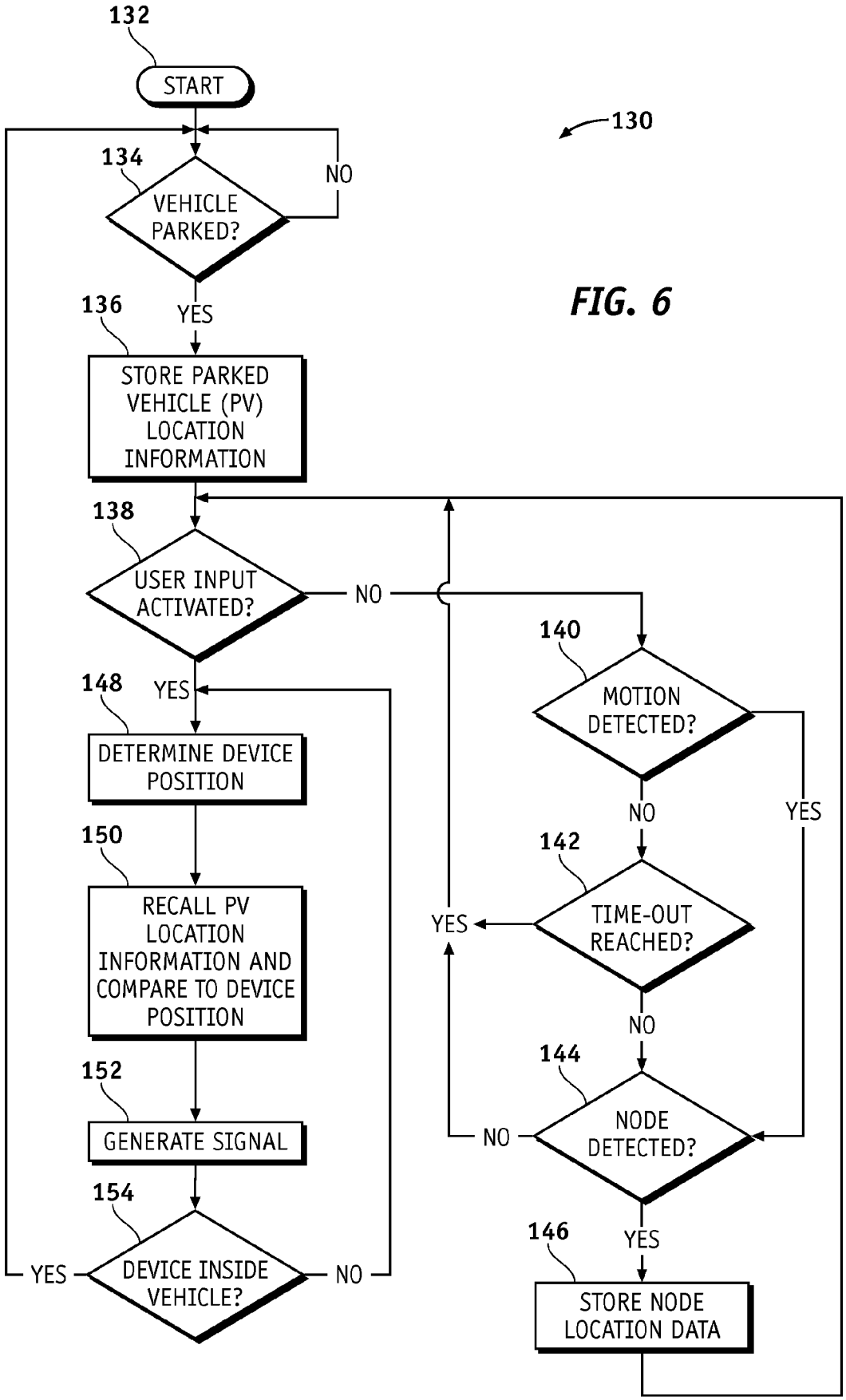
FIG. 6 is a flowchart illustrating an exemplary process utilized by the vehicle location system shown in FIG. 4 to guide the user shown in FIG. 5 back to the parked vehicle.

FIG. 6 is a flowchart illustrating a process 130 that may be performed by controller 80 of location system 70 (FIG. 4) to guide user 116 (FIG. 5) back to parked vehicle 120. To begin (START 132), controller 80 first determines if vehicle 120 has been parked (STEP 134). As will be appreciated, controller 80 may determine this in a number of different manners (e.g., by monitoring the vehicle's PRNDL switch, by determining when vehicle's ignition has been turned off, or by determining when the driver's side door has been opened and the vehicle door subsequently locked). After establishing that vehicle 120 has been parked, controller 80 stores location information in memory 82 indicative of the vehicle's parked location (STEP 136). This vehicle location information may comprise, for example, GPS coordinates that are provided by a GPS system onboard vehicle 120. Alternatively, the vehicle location information may comprise location-specific information broadcast by a local wireless node.

After storing information relating to the vehicle's location (STEP 136) in memory 82, controller 80 next determines if user input 84 has been activated; e.g., if button 36 (FIG. 1) or button 62 (FIG. 2) has been depressed (STEP 138). If it is determined that user input 84 has not been activated, controller 80 determines if motion is detected by motion detector 88 (STEP 140). If motion is detected, controller 80 establishes whether a wireless node is currently detected by network receiver 74 (STEP 144) as described below. If motion is not detected, controller 80 determines whether a time-out has been reached (STEP 142). Controller 80 makes this determination by reference to a predetermined time period (e.g., two minutes). If controller 80 determines that motion has not been detected for the pre-determined time period, controller 80 enters a quiescent mode until motion detector 88 again detects motion (STEP 140) or user input 84 is activated (STEP 138).

After determining that motion has been detected (STEP 140) or that a time-out has not been reached (STEP 142), controller 80 next establishes whether a location-specific wireless node signal is currently detected by network receiver 74 (STEP 144). If such a signal is not detected, controller 80 returns to STEP 138. However, if such a signal is detected, the node location data provided by the node is stored in memory 82 (STEP 146) and controller 80 returns to STEP 138. If multiple location-specific signals are detected, controller 80 may identify which signal is broadcast by the nearest node by, for example, comparing signal strength. Thus, by repeating STEPS 140, 142, 144, and 146, controller 80 may continually update the approximate location of the portable electronic device carrying system 70 by reference to the location of the nodes passed while user 116 walks along path 118.

Upon activation of user input 84, controller 80 estimates the location of the device carrying vehicle location system 70 (STEP 148). This may be accomplished by utilizing GPS device 90 as described above; however, in accordance with an exemplary embodiment of the present invention, this may also be accomplished by referring to the node location data stored in memory 82 previously provided by the local wireless nodes encountered along path 118. Controller 80 may determine the location of location system 70 by simply recalling the data associated with the last location-specific signal received and assume the location of system 70 to be substantially equivalent to the position of that particular node (e.g., node 114). However, for increased accuracy, controller 80 may instead utilize the data associated with the last location-specific signal as a reference point and extrapolate the current location of system 70 utilizing direction and distance information provided by DR device 92, and, if available, GPS data provided by GPS device 90.

Figure 7:
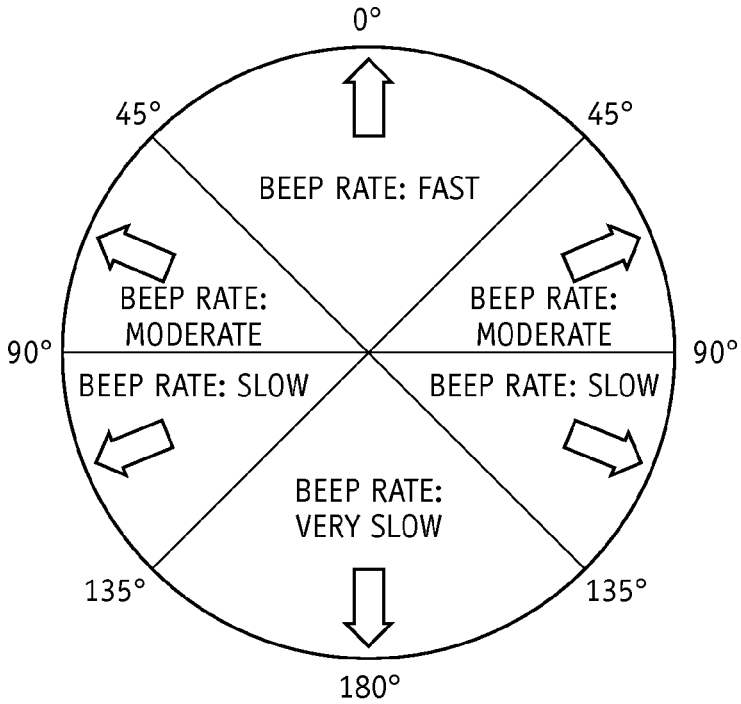
FIG. 7 is a diagram illustrating one manner in which audible signals produced by the vehicle location system shown in FIG. 4 may be altered in relation to the heading of the system relative to the location of the vehicle.

After the location of location system 70 has been estimated (STEP 148), the vehicle location information is recalled from memory 82 and compared to the estimated device location (STEP 150) to determine the position of vehicle 120 relative to the device. Following this, controller 80 generates a signal indicative of the position of vehicle 120 relative to the device via position indicator 78 (STEP 152). As explained above, this signal may comprise audible or visual cues. The generated signal may be indicative of the distance between location system 70 and vehicle 120 (e.g., a graphical indication of the distance between system 70 and vehicle may be generated as shown in FIG. 1 at 42, or a series of beeps may be produced wherein the frequency of the beeps increases as the distance between the device and vehicle 120 decreases). In addition, or alternatively, the generated signal may be indicative of the direction of vehicle 120 relative to the device. In this case, a visual signal may take the form of an arrow and an audible signal may take the form of a series of beeps that varies in frequency in relation to location of vehicle 120 relative to the heading of the device carrying system 70. For example, as illustrated in FIG. 7, system 70 may produce beeps at a relatively fast rate when the device is headed towards (pointed at) the location of vehicle 120 (0 degrees) or offset from this heading by 45 degrees in either the clockwise or counter-clockwise direction. If the heading of the device is offset from the direction of the vehicle 120 by 45-90 degrees, system 70 may produce beeps at a moderate rate. If the heading of the device is offset from the direction of the vehicle by 90-135 degrees, system 70 may produce beeps at a slow rate. Finally, if the heading of the device is offset from the direction of the vehicle by 135-180 degrees, system 70 may produce beeps at a very slow rate. These generated signals may thus guide user 116 back to parked vehicle 120.

After generating a signal indicative of the position of parked vehicle 120, controller 80 determines whether the device carrying location system 70 is within vehicle 120 (STEP 154) and, therefore, no longer needed to assist user 116 back to vehicle 120. If the device has not yet been placed inside the vehicle, controller 80 repeats STEPS 148, 150, and 152 to provide further direction guidance to user 116. However, after the device has been placed inside vehicle 120 and user 116 no longer requires direction guidance, controller 80 returns to STEP 134 and process 130 is repeated. In the illustrated exemplary process, controller 80 does not store node location data from wireless nodes after user input 84 has been activated; however, it should be appreciated that, in alternative embodiments of process 70, controller 80 may be configured to continually update the node location data stored in memory 82 during the performance of STEPS 148, 150, 152, and 154.

Figure 8:
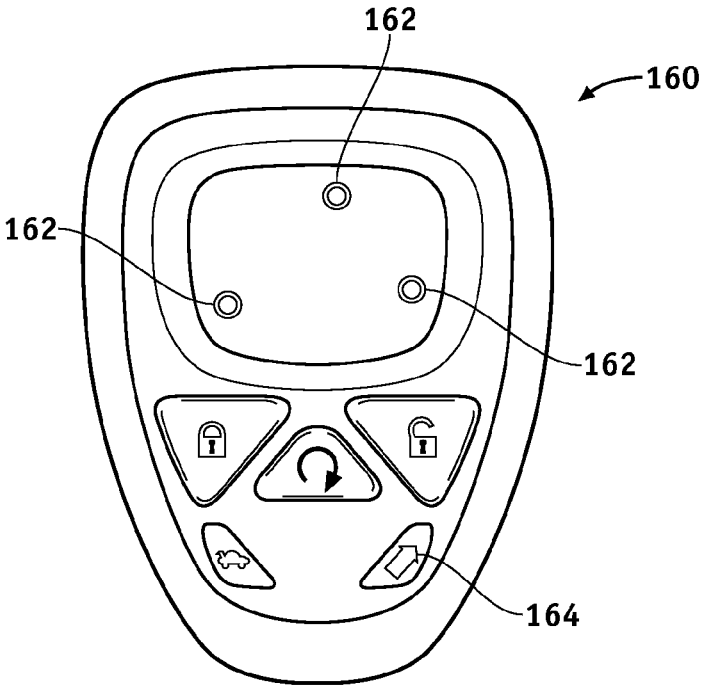
FIG. 8 is a plan view of a keyfob having a parked vehicle location function in accordance with a third exemplary embodiment of the present invention.

Of course, other embodiments of the parked vehicle location system may produce visual and audible signals other than those described above. For example, display 38 of keyfob 20 (FIG. 1) may be configured to produce a map thereon, which may include the present location of keyfob 20, the estimated location of vehicle 120 (FIG. 5), and/or a suggested path from keyfob 20 to vehicle 120. Furthermore, other embodiments of the parked vehicle location system may employ a visual displays means other than display 38. To further illustrate this point, FIG. 8 is a plan view a keyfob 160 having a plurality (e.g., three) light emitting diodes (LEDs) 162 disposed thereon. When button 164 is depressed to activate the parked vehicle location function, keyfob 160 may utilize LEDs 162 to indicate the direction and/or the distance between keyfob 160 and a vehicle associated therewith. For example, keyfob 160 may activate a selected one of LEDs 162 to indicate the direction of the vehicle relative to keyfob 160 in much the same manner as keyfob 20 generates arrows on display 38 to indicate the vehicle's direction. Advantageously, LED displays of this type are relatively inexpensive to employ and have modest power requirements.

It view of the above, it should be appreciated that a parked vehicle location system has been provided that may guide a user back to his or her vehicle without the aid of satellite signals, which may be employed in a electronic device (e.g., a keyfob) configured to be carried on the user's person. Although described above as utilizing location-specific signals provided by wireless nodes to determine the location of system 70, it should be understood that controller 80 may also employ other radiolocation means in determining the location of system 70 including assisted GPS and enhanced 911 (E911). It should also be understood that, in certain embodiments, system 70 may determine the location of the parked vehicle by wirelessly querying the vehicle after activation of the vehicle location function in the well-known manner.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any manner. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An electronic device configured to be carried on a user's person for directing the user to a parked vehicle, the electronic device utilizing node location data provided by at least one local wireless node and vehicle location information provided by the vehicle, the electronic device comprising:

a motion detector configured to determine when the electronic device is in motion;

a network receiver configured to receive the node location data from the at least one local wireless node; and a controller coupled to the motion detector and to the network receiver, the controller configured: to store the vehicle location information; to monitor for the availability of node location data in response to detection of motion by the motion detector; to receive node location data, when available, via the network receiver; to estimate the location of the electronic device from the received node location data; and to determine the position of the vehicle relative to the electronic device.

2. An electronic device according to claim 1 further comprising a vehicle position indicator coupled to the controller and configured to generate at least one signal indicative of the position of the vehicle relative to the electronic device.

3. An electronic device according to claim 2 wherein the vehicle position indicator comprises a display.

4. An electronic device according to claim 2 wherein the vehicle position indicator comprises a sound generator.

5. An electronic device according to claim 1 further comprising a user input coupled to the controller, the controller configured to determine the position of the vehicle relative to the electronic device when the user input is activated.

6. An electronic device according to claim 1 further comprising a vehicle link receiver coupled to the controller, the vehicle link receiver configured to receive the vehicle location information provided by the vehicle and to transmit the vehicle location information to the controller.

7. An electronic device according to claim 6 wherein the vehicle link receiver comprises a radiofrequency transceiver.

8. A keyfob for directing a user to a parked vehicle, the keyfob utilizing node location data provided by at least one wireless node, the keyfob comprising:

a vehicle link receiver configured to receive vehicle location information from the vehicle;

a network receiver configured to receive the node location data;

a controller coupled to the vehicle link receiver and to the network receiver, the controller configured to estimate the position of the vehicle relative to the keyfob utilizing the vehicle location information and the received node location data; and a vehicle position indicator coupled to the controller and configured to generate a series of beep, the controller configured to vary the frequency of the series of beeps generated by the vehicle position indicator to indicate the position of the vehicle relative to the keyfob.

9. A keyfob according to claim 8 further comprising:

a housing containing the vehicle link receiver, the network receiver, and the controller; and a button disposed on the housing;

wherein the vehicle position indicator is coupled to the housing and configured to generate the signal indicative of the position of the vehicle relative to the keyfob when the button is depressed.

10. A keyfob according to claim 8 further comprising a dead reckoning device coupled to the controller.

11. A keyfob according to claim 10 wherein the dead reckoning device includes:

a motion detector; and an electronic compass.

12. A process carried out by an electronic device carried by a user for guiding the user to a vehicle, the process comprising:

storing vehicle location information;

receiving wireless node location data;

estimating the location of the electronic device from the received node location data;

determining the position of the vehicle relative to the electronic device;

generating a signal indicative of the position of the vehicle relative to the electronic device; and determining if the electronic device is within the vehicle;

wherein the step of estimating the location of the electronic device from the received node location data and the step of generating a signal indicative of the position of the vehicle relative to the electronic device are performed in a continuous loop until it is determined that the electronic device is within the vehicle.

13. A process according to claim 12 further comprising altering the generated signal in relation to the heading of the electronic device relative to the position of the vehicle.

14. A process according to claim 12 further comprising altering the generated signal in relation to distance between the vehicle and the electronic device.

15. A process according to claim 12 wherein the electronic device includes a user input, wherein the process further comprises receiving an activation signal from the user input, and wherein the step of generating a signal is performed in response to the activation signal.

16. A process according claim 12 wherein the electronic device includes a motion detector, and wherein the process further comprises monitoring for the node location data when motion is detected by the motion detector.

17. A process according to claim 12 wherein the step of receiving comprises receiving wireless node location data at a low data transmission rate.

18. A process according to claim 12 wherein the step of storing comprises:

determining when the vehicle has been parked; and receiving the vehicle location information from the vehicle after the vehicle has been parked.

* * * * *